US008235758B2

(12) United States Patent
Hsu

(10) Patent No.: US 8,235,758 B2
(45) Date of Patent: Aug. 7, 2012

(54) ROTATABLE PLUG

(75) Inventor: Jung-Hui Hsu, Taipei County (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 12/917,624

(22) Filed: Nov. 2, 2010

(65) Prior Publication Data

US 2012/0052746 A1 Mar. 1, 2012

(30) Foreign Application Priority Data

Aug. 27, 2010 (TW) ..... 99128967 A

(51) Int. Cl.
*H01R 13/514* (2006.01)

(52) U.S. Cl. ..... 439/701

(58) Field of Classification Search ..... 439/701, 439/131, 11, 358, 8, 6, 23, 173, 172
See application file for complete search history.

(56) References Cited

U.S. PATENT DOCUMENTS

| | | | | |
|---|---|---|---|---|
| 5,110,224 | A * | 5/1992 | Taylor et al. | 385/25 |
| 5,218,657 | A * | 6/1993 | Tokudome et al. | 385/70 |
| 5,425,645 | A * | 6/1995 | Skovdal et al. | 439/23 |
| 7,494,343 | B2 * | 2/2009 | Schriefer | 439/11 |

FOREIGN PATENT DOCUMENTS

TW 565062 M 12/2003

* cited by examiner

*Primary Examiner* — Alexander Gilman
(74) *Attorney, Agent, or Firm* — Rosenberg, Klein & Lee

(57) ABSTRACT

A rotatable plug includes a plug portion and a base portion rotatably connected to the plug portion, an angle is formed by a rotational axis of the base portion and a center axis of the plug portion, and when the base portion rotates about rotational axis, the plug portion is folded to the base portion.

13 Claims, 7 Drawing Sheets

ROTATABLE PLUG

BACKGROUND OF THE INVENTION

1. Field of the Invention

The present invention is related to a rotatable plug, and more particularly to a rotatable plug having a plug portion and a base portion rotatably connected to each other in a way that the angle between the rotational axes of the two portions changes with the relative rotational motion.

2. Description of Related Art

A conventional plug that wishes to achieve the changing orientation of its plug portion requires complicated structure. An example of such conventional plug device is disclosed in R.O.C. patent No. 565062, which has rotatable pins and a cable end. Such complicated design may be structurally unreliable and cause safety problems.

SUMMARY OF THE INVENTION

The object of the present invention is to provide a rotatable plug having a plug portion and a base portion rotatably connected to the plug portion. An angle is formed between a rotational axis of the base portion and a center axis of the plug portion. When the base portion rotates about rotational axis, the plug portion is folded to the base portion.

Since a cable of the invention is connected to the pins, no rotatable connection structure is desired. The structure is simplified and the safety problem can be solved. When the base portion rotates about rotational axis, the cable in the first and base portions is not twisted.

When the base portion rotates about rotational axis, the plug portion is folded to the base portion. Such a rotatable and foldable structure may satisfy market requirement.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
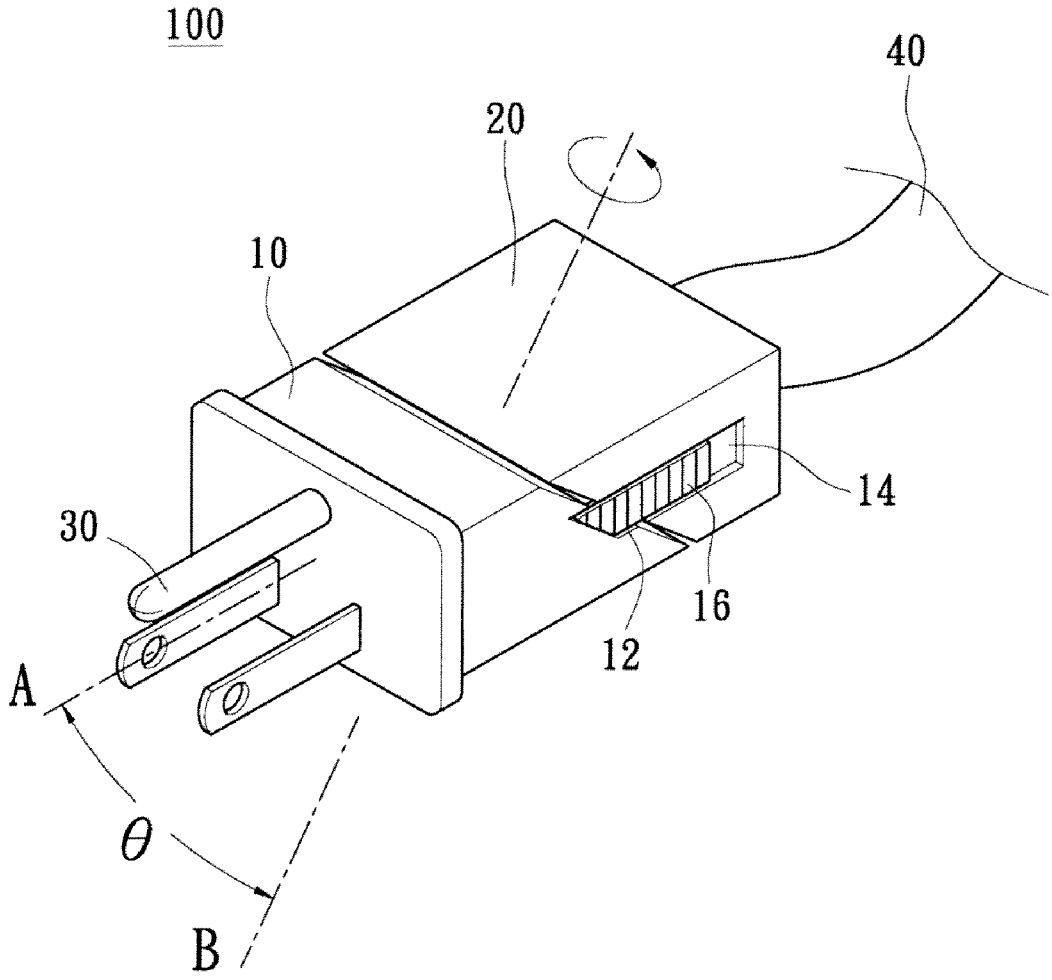
FIG. 1 is a perspective view showing a first positioning status of a rotatable plug of the invention.
Figure 2:
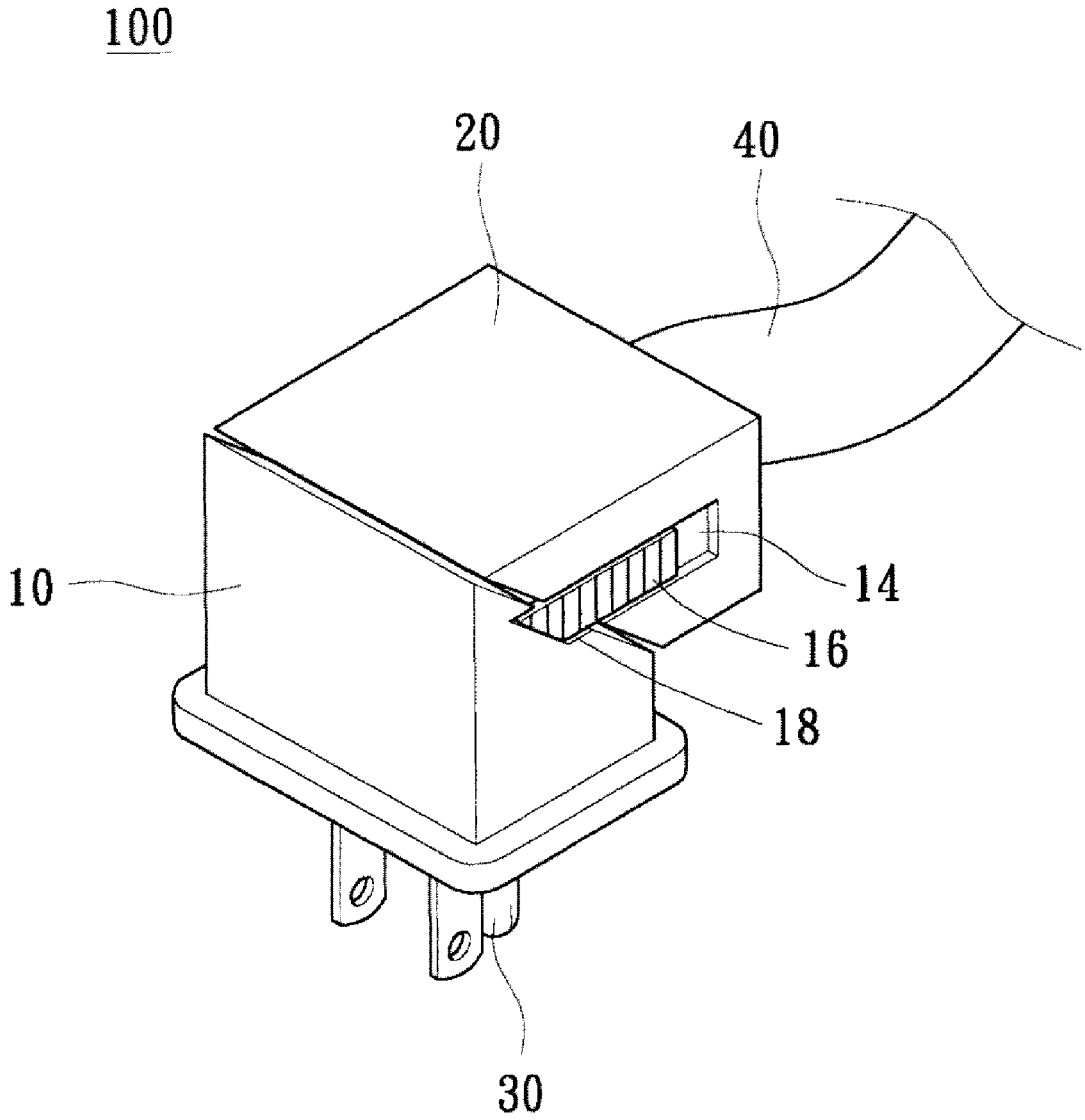
FIG. 2 is a perspective view showing a second positioning status of a rotatable plug of the invention.

Referring to FIGS. 1 and 2, a plug 100 of the invention comprises a plug portion 10 and a base portion 20. The plug portion 10 has protruding pins 30. A cable 40 is connected to the pins 30. The base portion 20 is rotatably coupled to the plug portion 10. An angle θ is formed between a pivot axis B of the base portion 20 and a central axis A of the plug portion 10. The angle θ is preferably ranged between 0° and 90°. For example, the angle θ can be ranged between 0° and 90°, or between 25° and 65°, or between 35° and 55°. The optimal angle θ can be 45°. In addition, a positioning element 16 movable forward or backward is disposed on the base portion 20. Before the base portion 20 rotates, the positioning element 16 moves forward to enter a first groove 12 formed on the plug portion 10, whereby the base portion 20 is positioned in a first positioning status (as shown in FIG. 1). When the positioning element 16 moves backward to leave the first groove 12, the base portion 20 becomes rotatable about the pivot axis B. When positioning element 16 moves forward to enter a second groove 18 formed on the plug portion 10, the base portion 20 is positioned in a second positioning status (as shown in FIG. 2). In addition, the base portion 20 has a groove 14 receiving the positioning element 16.

Figure 3:
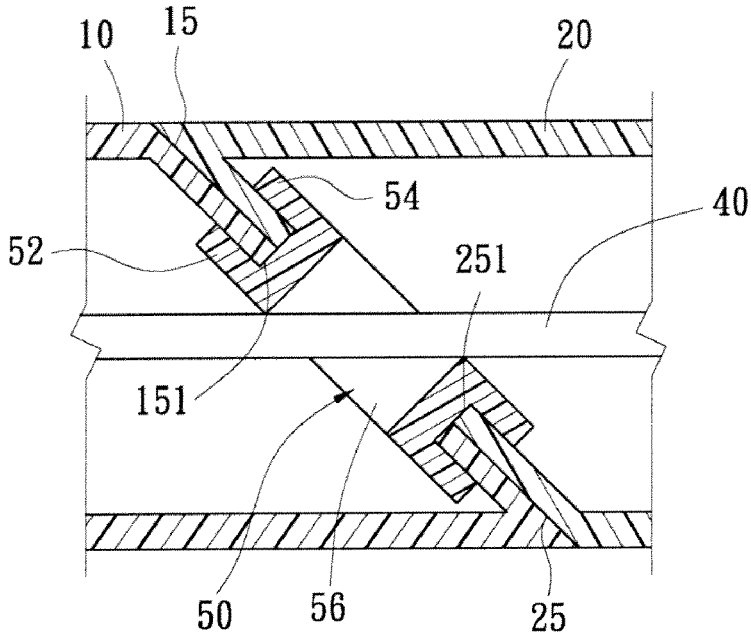
FIG. 3 is a partial cross-sectional view showing one embodiment of the rotatable structure of the rotatable plug of the invention.

Referring to FIG. 3, the plug portion 10 is rotatably connected to the base portion 20 by a hinge member 50. The hinge member 50 extends through a hole 151 formed on the plug portion 10 and a hole 251 formed on the base portion 20. The hinge member 50 has center hole 56 for the cable 40 extending therethrough. A first stop portion 52 and a second stop portion 54 are disposed on two ends of the hinge member 50. The hinge member 50 is fixed to the plug portion 10 by the first stop portion 52 and fixed to the base portion 20 by the second stop portion 54. The plug portion 10 has a first slanting surface 15, and the base portion 20 has a second slanting surface 25 corresponding to the first slanting surface 15. The hinge member 50 can be assembled to the plug portion 10 and the base portion 20 by dividing the plug portion 10 and the base portion 20 into two half portions (not shown) respectively. The holes 151 and 251 are also divided into two half portions. When the two half portions of the plug portion 10 are assembled to one end of the hinge member 50, the first stop portion 52 are disposed in the plug portion 10. When the two half portions of the base portion 20 are assembled to another end of the hinge member 50, the second stop portion 54 are disposed in the base portion 20. Certainly, the assembly of plug portion 10, the base portion 20 and the hinge member 50 is not limited thereto.

Figure 3A:
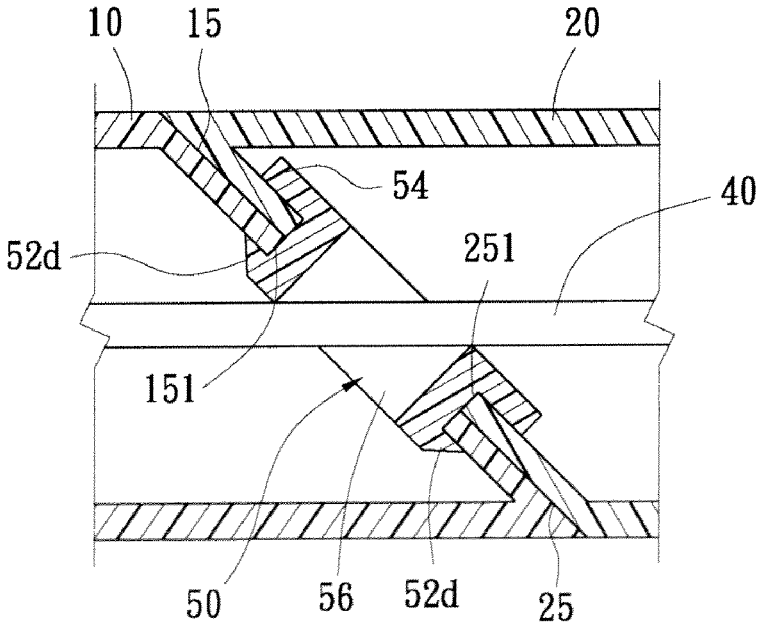
FIGS. 3A and 3B are partial cross-sectional views showing one embodiment of the rotatable structure of the rotatable plug of the invention.
Figure 3B:
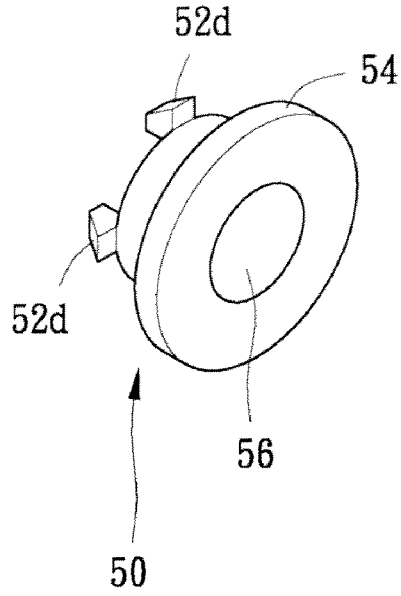

Referring to FIGS. 3A and 3B, a plurality of elastic latches 52*d* and the second stop portion 54 are disposed on two ends of the hinge member 50. The elastic latches 52*d* easily enter the hole 151 of the plug portion 10, whereby the hinge member 50 is fixed to the plug portion 10. Similarly, the hinge member 50 is fixed to the base portion 20 by the second stop portion 54.

Figure 4:
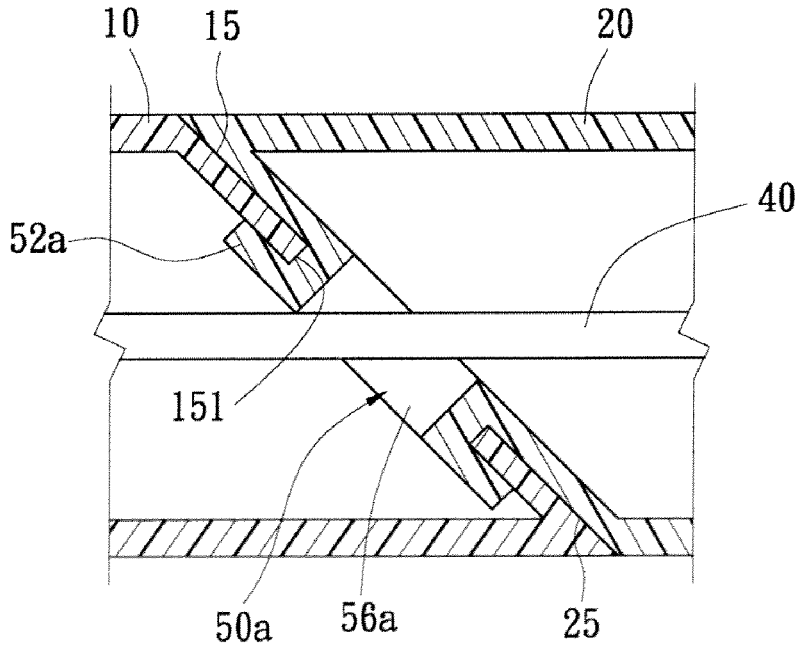
FIG. 4 is a partial cross-sectional view showing another embodiment of the rotatable structure of the rotatable plug of the invention.

Referring to FIG. 4, the base portion 20 is integrated with a hinge member 50*a*. The base portion 20 is rotatably connected to the plug portion 10 by the hinge member 50 entering the hole 151. A center hole 56 is formed on the hinge member 50*a* for the cable 40 extending therethrough. A first stop portion 52*a* is formed on one end of the hinge member 50*a*. The plug portion 10 is fixed to the hinge member 50 by the first stop portion 52*a*. The hinge member 50*a* can be assembled to the plug portion 10 by dividing the plug portion 10 into two half portions (not shown). The hole 151 is also divided into two half portions. When the two half portions of the plug portion 10 are assembled to one end of the hinge member 50*a*, the first stop portion 52*a* are disposed in the plug portion 10. Certainly, the assembly of plug portion 10 and the hinge member 50*a* is not limited thereto.

Figure 5:
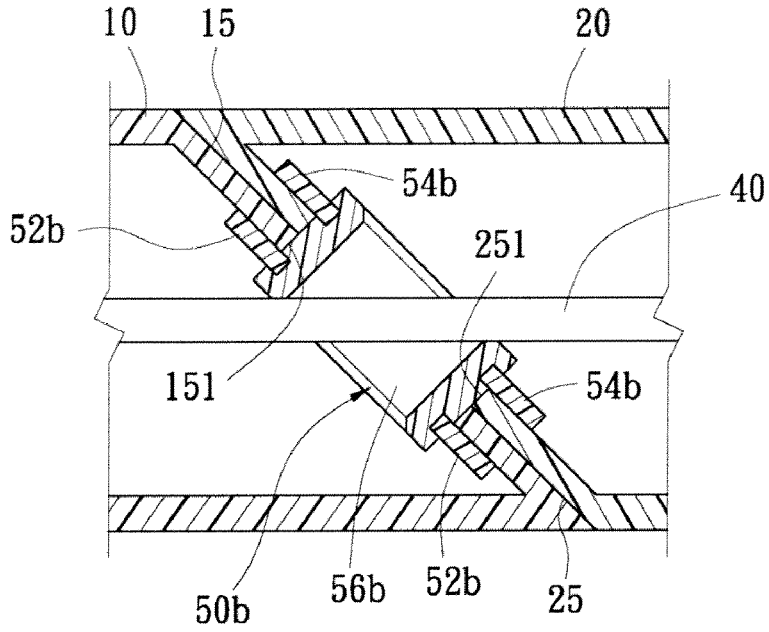
FIG. 5 is a partial cross-sectional view showing another embodiment of the rotatable structure of the rotatable plug of the invention.

Referring to FIG. 5, the plug portion 10 and the base portion 20 are rotatably connected to each other by a hinge member 50*b*. The hinge member 50*b* extends through the hole 151 formed on the plug portion 10 and a hole 251 formed on the base portion 20. The center hole 56 is formed on the hinge member 50*b* for the cable 40 extending therethrough. A C clamp 52*b* and a C clamp 54*b* are disposed on two ends of the hinge member 50*b* respectively, whereby the plug portion 10 is fixed to hinge member 50*b* by the C clamp 52*b* and the base portion 20 is fixed to the hinge member 50*b* by the C clamp 54*b*. The assembly of the plug portion 10, the base portion 20 and the hinge member 50*b* is that the hinge member 50*b* enters the hole 151 on the plug portion 10 and the hole 251 on the base portion 20, and the C clamps 52*b* and 54*b* are fixed to two ends of the hinge member 50*b*, whereby the C clamp 52*b* is disposed in the plug portion 10 and the C clamp 54*b* is disposed in the base portion 20. Of course, the assembly of plug portion 10, the base portion 20 and the hinge member 50*b* is not limited thereto.

Figure 6:
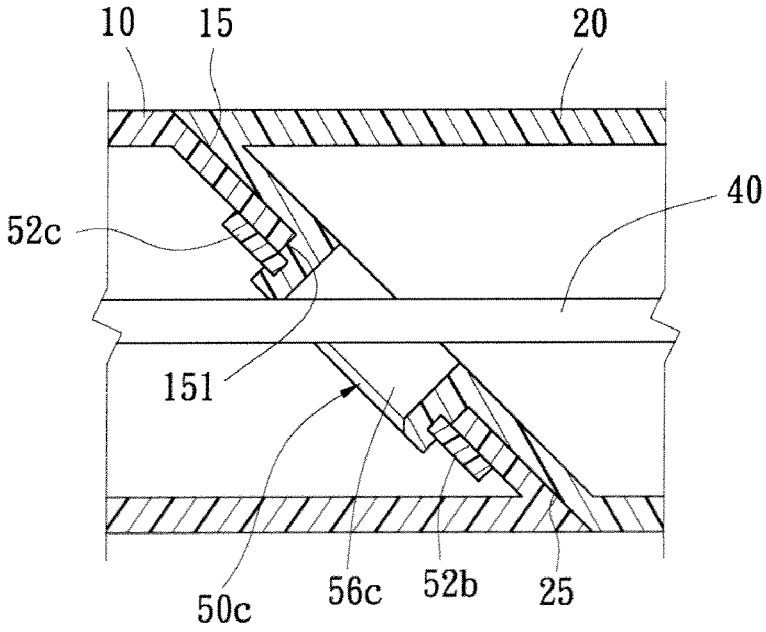
FIG. 6 is a partial cross-sectional view showing another embodiment of the rotatable structure of the rotatable plug of the invention.

Referring to FIG. 6, the base portion 20 is integrated with a hinge member 50*c*. The base portion 20 is rotatably connected to the plug portion 10 by the hinge member 50*c* entering the hole 151. A center hole 56 is formed on the hinge member 50*c* for the cable 40 extending therethrough. A C clamp 52*c* is disposed on one end of the hinge member 50*c*. The plug portion 10 is fixed to the hinge member 50*c* by the C clamp 52*c*. The preferred assembly of the hinge member 50*c* is that the hinge member 50*c* extends through the hole 151, and the C clamp 52*c* is fixed to one end of the hinge member 50*c*, whereby the C clamp 52*c* is disposed in the plug portion 10. Certainly, the assembly of plug portion 10 and the hinge member 50*c* is not limited thereto.

Figure 7:
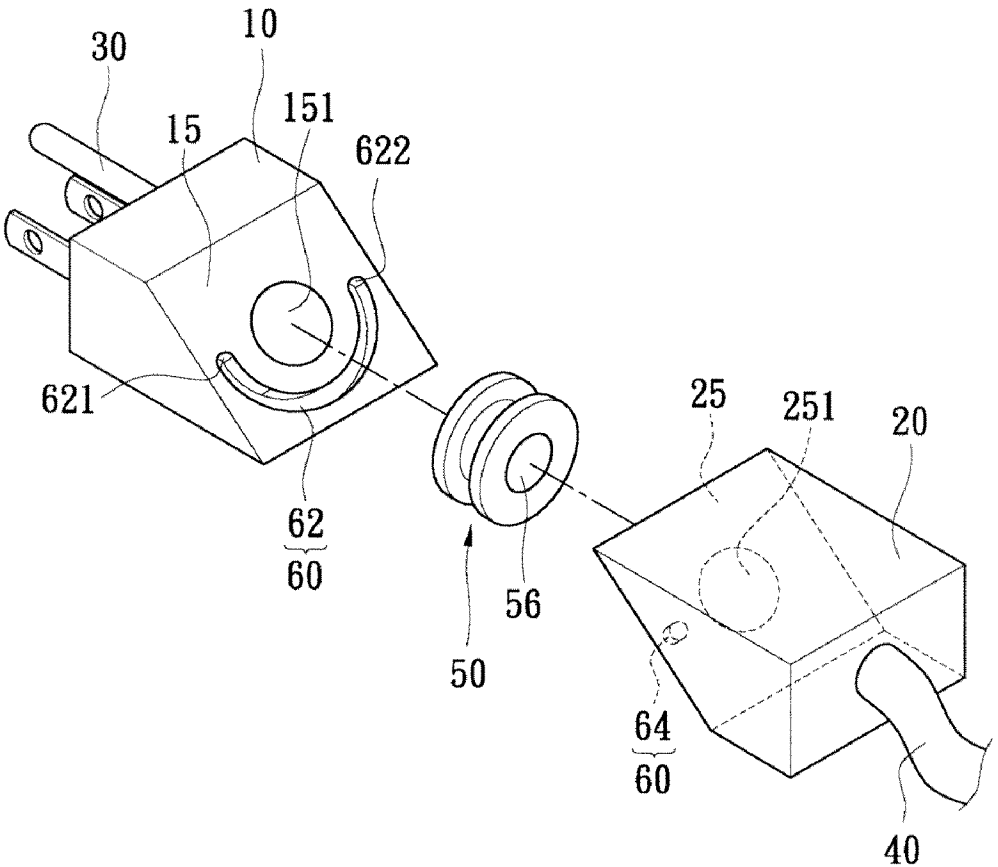
FIG. 7 is an exploded view of an embodiment of a limit mechanism of a rotatable plug of the invention.

Referring to FIG. 7, a limiting mechanism 60 is disposed between the plug portion 10 and the base portion 20. For example, a semicircular groove 62 is formed on the first slanting surface 15, and a post 64 is disposed on the second slanting surface 25. The post 64 is received in the groove 62 and movable between a first end wall 621 and a second end wall 622, whereby the rotation of the base portion 20 is limited to a predetermined range.

Figure 8:
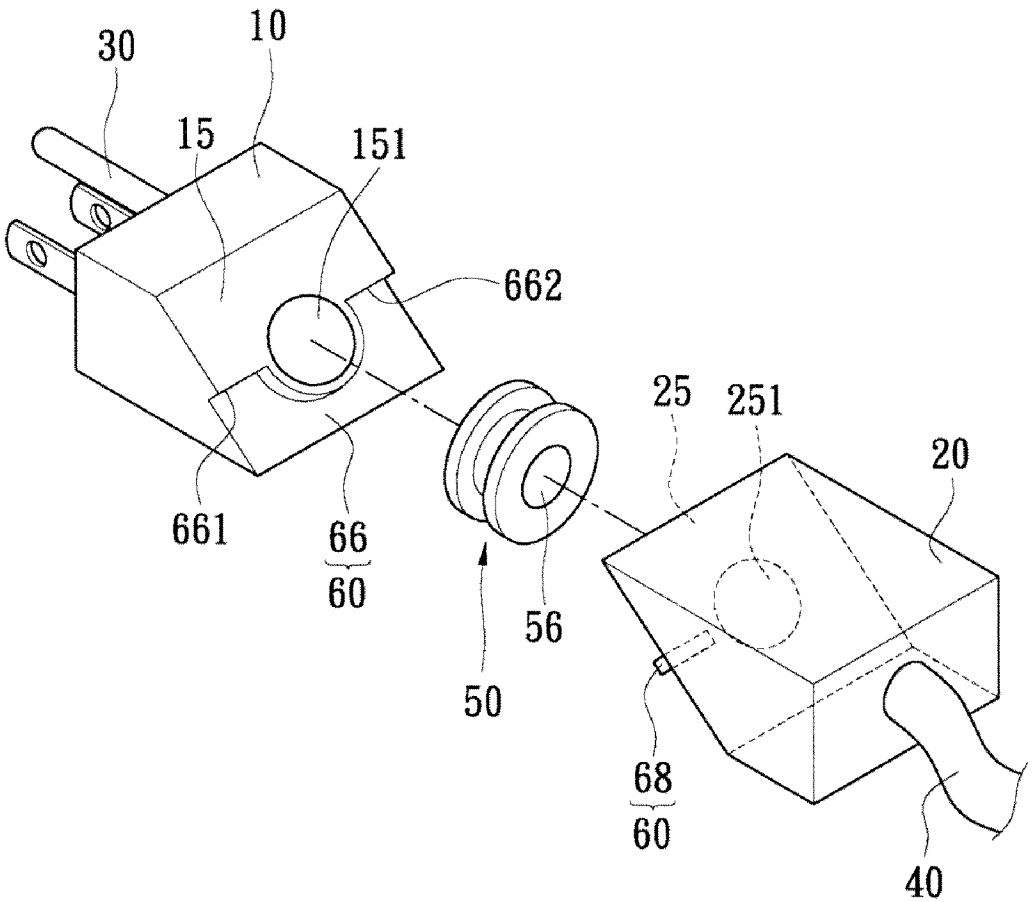
FIG. 8 is an exploded view of another embodiment of a limit mechanism of a rotatable plug of the invention.

Referring to FIG. 8, a limiting mechanism 60 is disposed between the plug portion 10 and the base portion 20. For example, a depression 66 is formed on the first slanting surface 15, and a post 68 is disposed on the second slanting surface 25. The depression 66 is lower than the first slanting surface 15. The post 68 is movable between the first end wall 661 and the second wall 662, whereby the rotation of the base portion 20 is limited to a predetermined range.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A rotatable plug, comprising:

a plug portion (10) comprising at least one conductive pin (30) having a first axis (A) through a first slanting surface (15), the at least one conductive pin being exposedly arranged along the first axis; and a base portion (20) having a second axis through a second slanting surface (25), the base portion joining the plug portion through rotatable coupling between the first and the second slanting surfaces with the first and the second axis aligning each other;

wherein the included angle between the first and the second axes changes with the relative rotational motion between the plug and the base portions, wherein the included angle ranges between 90° and 180°.

2. The rotatable plug as claimed in claim 1 further comprising a hinge member extending through holes formed on the plug portion and the base portion to rotatably connect the plug portion and the base portion, wherein the hinge member has a center hole formed therethrough, a first stop portion and a second stop portion on two ends thereof.

3. The rotatable plug as claimed in claim 1 further comprising a hinge member extending through holes formed on the plug portion and the base portion to rotatably connect the plug portion and the base portion, wherein the hinge member has a center hole formed therethrough, a plurality of elastic latches on one end and a second stop portion on another end.

4. The rotatable plug as claimed in claim 1 further comprising a hinge member formed on the base portion and extending through one hole formed on the plug portion, wherein the hinge member has a center hole formed therethrough, a stop portion on one end.

5. The rotatable plug as claimed in claim 1 further comprising a hinge member formed on the base portion and extending through one hole formed on the plug portion, wherein the hinge member has a center hole formed therethrough, a plurality of elastic latches on one end.

6. The rotatable plug as claimed in claim 1 further comprising a hinge member extending through holes formed on the plug portion and the base portion to rotatably connect the plug portion and the base portion, wherein the hinge member has a center hole formed therethrough, and C clamps are disposed on two ends of the hinge member.

7. The rotatable plug as claimed in claim 1 further comprising a hinge member formed on the base portion and extending through one hole formed on the plug portion, wherein the hinge member has a center hole formed therethrough, and a C clamp is disposed on one end of the hinge member.

8. The rotatable plug as claimed in claim 1 further comprising a positioning element capable of moving forward and backward, wherein when the positioning element moves forward to enter a first groove formed on the plug portion, the base portion is in a first positioning status, and when the positioning element moves forward to enter a second groove formed on the plug portion, the base portion is in a second positioning status.

9. The rotatable plug as claimed in claim 8 wherein the base portion has a groove to receive the positioning element.

10. A rotatable plug comprising:

a plug portion having a first slanting surface comprising at least one conductive pin therein, wherein the first slanting surface has a semicircular groove having a first end and a second end formed thereon; and a base portion having a second slanting surface rotatably coupled to the plug portion, wherein the second slanting surface includes a protruding member disposed thereon and arranged in the semicircular groove between the first end and the second end;

wherein a pivot axis of the base portion and a central axis of the plug portion together define an angle θ, the angle θ is ranged between 25° and 65° ($25° < \theta < 65°$).

11. The rotatable plug as claimed in claim 10 further comprising a hinge member formed on the base portion and extending through one hole formed on the plug portion, wherein the hinge member has a center hole formed therethrough, a stop portion on one end, and the plug portion has a first slanting surface, and the base portion has a second slanting surface corresponding to the first slanting surface.

12. The rotatable plug as claimed in claim 10 further comprising a hinge member formed on the base portion and extending through one hole formed on the plug portion, wherein the hinge member has a center hole formed therethrough, and a C clamp is disposed on one end of the hinge member, and the plug portion has a first slanting surface, and the base portion has a second slanting surface corresponding to the first slanting surface.

13. A rotatable plug comprising:

a plug portion having a first slanting surface comprising at least one conductive pin therein, wherein the first slanting surface has a depression portion having a first end wall and a second end wall formed thereon; and a base portion having a second slanting surface rotatably coupled to the plug portion, wherein the second slanting surface includes a protruding member disposed thereon and arranged between the first end wall and the second end wall of the depression portion;

wherein a pivot axis of the base portion and a central axis of the plug portion together define an angle $\theta$, the angle $\theta$ is ranged between 35° and 55° ($35° < \theta < 55°$).

* * * * *